US005501462A

United States Patent [19]

Shih

[11] Patent Number: 5,501,462

[45] Date of Patent: Mar. 26, 1996

[54] GOLF PRACTICE DEVICE FOR PLAYING

[76] Inventor: Wu-tung Shih, No. 16, Hoping Rd., Chaochou Chen, Pingtung Hsien, Taiwan

[21] Appl. No.: 510,864

[22] Filed: Aug. 3, 1995

[51] Int. Cl.[6] ..... A63B 67/02

[52] U.S. Cl. ..... 273/176 FA; 273/176 H; 273/201

[58] Field of Search ..... 273/176 F, 176 FA, 273/176 FB, 176 H, 201

[56] References Cited

U.S. PATENT DOCUMENTS 2,071,356 2/1937 Pagett ..... 273/201
3,366,387 1/1968 Koener ..... 273/176 FA
4,146,232 3/1979 Stone ..... 273/201

*Primary Examiner*—George J. Marlo
*Attorney, Agent, or Firm*—Parkhurst, Wendel & Rossi

[57] ABSTRACT

A golf practice device includes an inclined elongated base having a plurality of golf balls contained therein. An inlet hole is laterally defined in the base. A gate operating mechanism is mounted in the base and operates to stop the plurality of golf balls and to allow the plurality of golf balls to pass therethrough. An elongated plate is mounted on the base and an artificial sod covers the elongated plate. A socket is defined through the artificial sod and communicates with a passage defined in the base. A pivot member is pivotally mounted on the elongated plate for transporting the golf balls from the inlet hole of the base to the artificial sod of the elongated plate.

3 Claims, 7 Drawing Sheets

GOLF PRACTICE DEVICE FOR PLAYING

BACKGROUND OF THE INVENTION

1. Field of the Invention

The present invention relates to a golf practice device, and more particularly to a golf practice device for playing.

2. Related Prior Art

A conventional golf practice device comprises an elongated inclined plate having an artificial sod covered thereon and at least one hole defined therein such that a user can practice a putt skill repeatedly. However, by such an arrangement, the user has to pick up the golf ball each time after it has been putted into the hole by means of a golf club, so easily causing an inconvenience in practicing.

The present invention has arisen to mitigate and/or obviate the disadvantages of the conventional golf practice device.

SUMMARY OF THE INVENTION

The primary objective of the present invention is to provide a golf practice device for playing.

In accordance with one aspect of the present invention, there is provided a golf practice device comprising an inclined elongated base having a plurality of golf balls contained therein and including first and second end portions each having a first side and a second side. A passage is defined in the base for the plurality of golf balls to pass therethrough. An inlet hole is laterally defined in the first side of the first end portion of the base and communicates with the passage. A guiding plate is mounted in the passage for guiding the plurality of golf balls into the inlet hole.

A gate operating mechanism is mounted in the passage of the base and operates between a first module in which the plurality of golf balls are stopped by the gate operating mechanism and a second module in which the plurality of golf balls are able to pass therethrough. A control panel is mounted on the second end portion of the base for operating the gate operating mechanism.

An elongated plate is mounted on the base and includes first and second end portions each having a first side and a second side. An artificial sod covers the elongated plate. A substantially V-shaped flange is formed on the first end portion of the elongated plate and protrudes upwardly therefrom. A first socket is defined through the artificial sod and the second end portion of the elongated plate and communicates with the passage. At least one second socket is defined through the artificial sod and a mediate portion of the elongated plate and communicates with the passage.

A pivot member is pivotally mounted on the elongated plate and includes a pivot axle fixedly mounted on the first side of the first end portion of the elongated plate. A first lever has a first end which has a supporting bracket fixedly mounted thereon and a second end which is pivotally mounted on the pivot axle and has a recess defined therein. A second lever is fixedly attached to the second end of the first lever to pivot therewith about the pivot axle.

The pivot member is pivoted between a first position where the first end of the first lever is at a lowermost level thereof such that one of the plurality of golf balls is able to move through the inlet hole to be retained on the supporting bracket, and a second position where the first lever is disposed at a substantially horizontal state such that the golf ball is able to move from the supporting bracket into the recess and into the artificial sod.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
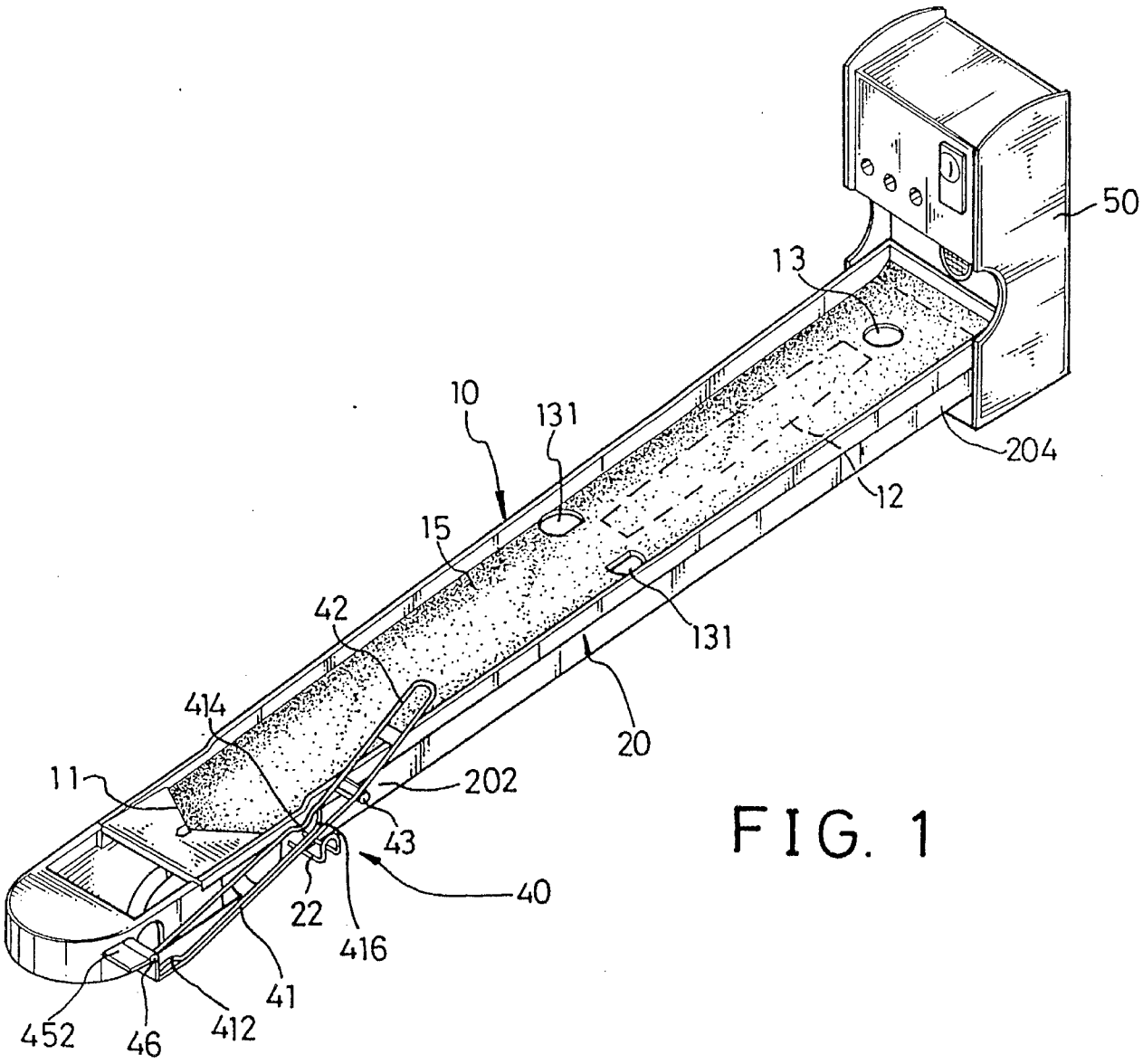
FIG. 1 is a perspective view of golf practice device in accordance with the present invention.
Figure 2:
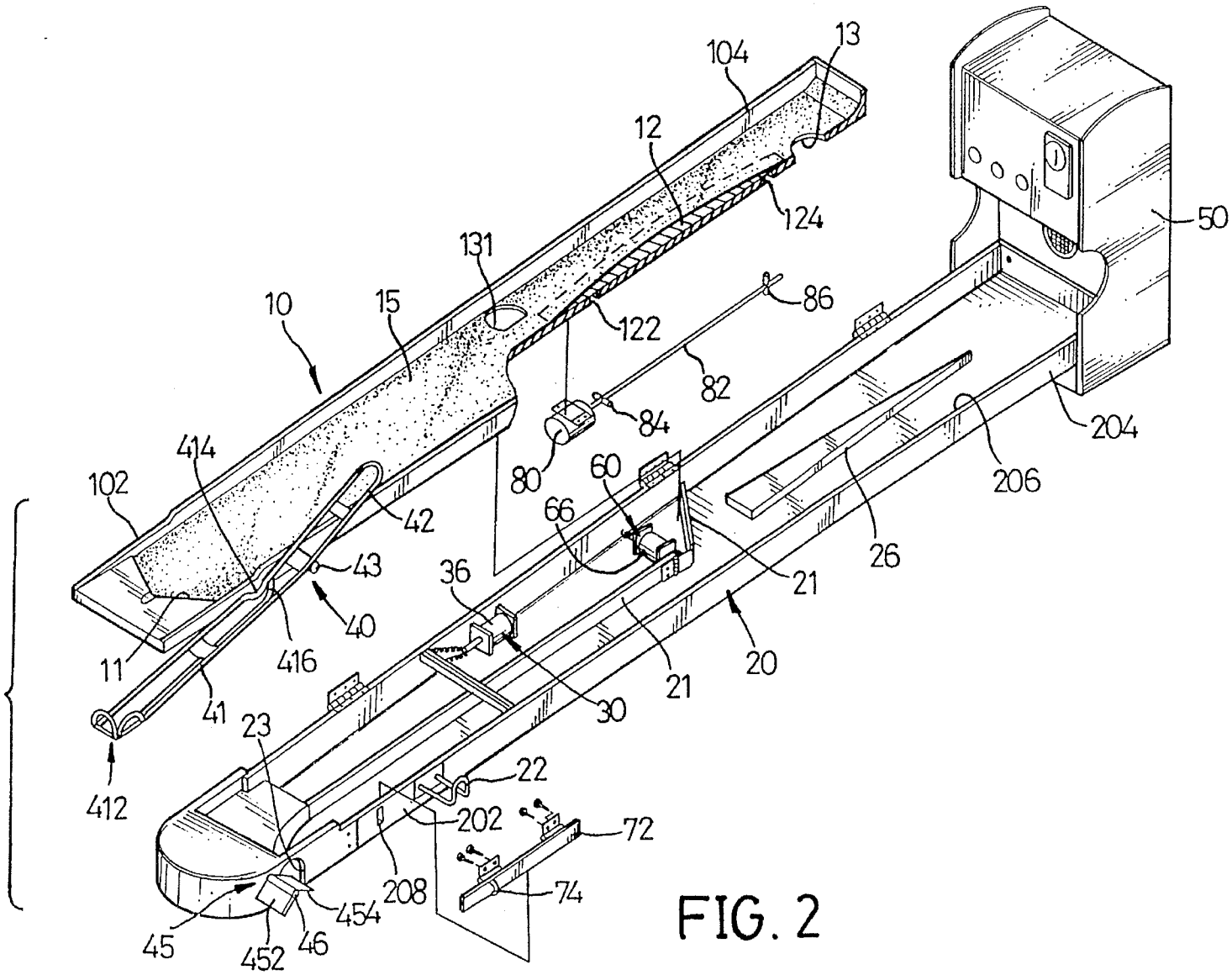
FIG. 2 is a partially cross-sectional exploded view of FIG. 1.

Referring to the drawings, and initially to FIGS. 1 and 2, a golf practice device in accordance with the present invention is provided for playing and comprises an inclined elongated base 20 having a plurality of golf balls 100 (see FIG. 5) contained therein and including first and second end portions 202 and 204 each having a first side and a second side. The first end portion 202 is at a level lower than that of the second end portion 204. A passage 206 is defined in the base 20 for the plurality of golf balls 100 to pass therethrough.

An inlet hole 23 is laterally defined in the first side of the first end portion 202 of the base 20 and communicates with the passage 206. A guiding plate 21 is mounted in the passage 206 for guiding the plurality of golf balls 100 to be introduced into the inlet hole 23 successively.

A gate operating mechanism 30 is disposed in the passage 206 of the base 20 and operates between a first module in which the plurality of golf balls 100 are stopped by the gate operating mechanism 30 and a second module in which the plurality of golf balls 100 are able to pass therethrough. A control panel 50 is mounted on the second end portion 204 of the base 20 for operating the gate operating mechanism 30.

Figure 3:
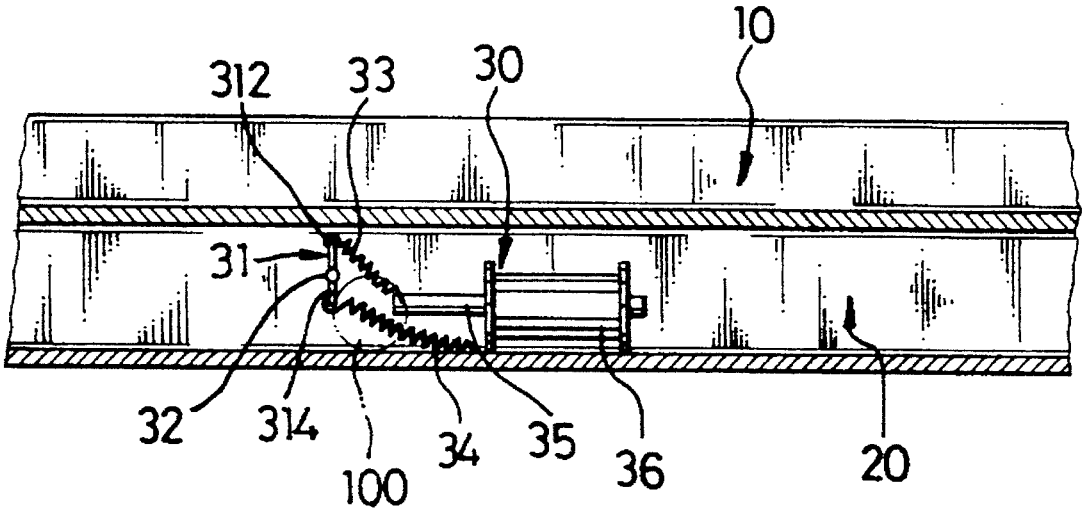
FIG. 3 is a front plan partially cutaway cross-sectional view of FIG. 1.
Figure 4:
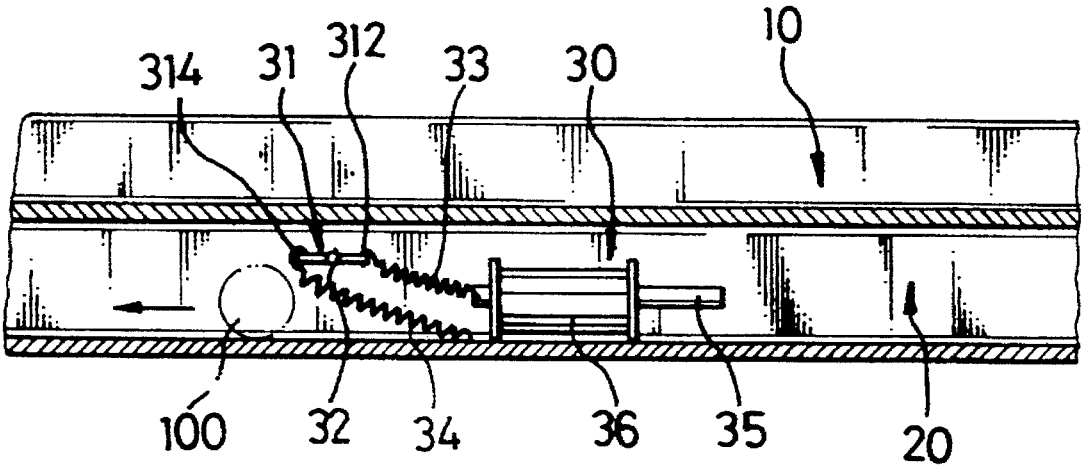
FIG. 4 is an operational view of FIG. 3.

Referring to FIGS. 3 and 4 with reference to FIGS. 1 and 2, the gate operating mechanism 30 comprises a pivot shaft 32 transversely and fixedly mounted on a mediate portion of the base 20. A gate 31 is pivotally mounted on the pivot shaft 32 and has first and second end portions 312 and 314 each pivoting about the pivot shaft 32. A first spring 33 has a first end attached to the first end portion 312 of the gate 31 and a second end. A control cylinder 36 is fixedly mounted on the base 20. A rod 35 is slidably mounted in the control cylinder 36 and has one distal end connected with the second end of the first spring 33. A second spring 34 has a first end attached to the second end portion 314 of the gate 31 and a second end attached to the base 20.

The control panel 50 is operated to force the rod 35 to displace from a locking position as shown in FIG. 3 to an open state as shown in FIG. 4 such that the golf balls 100 are able to move forwardly.

Figure 5:
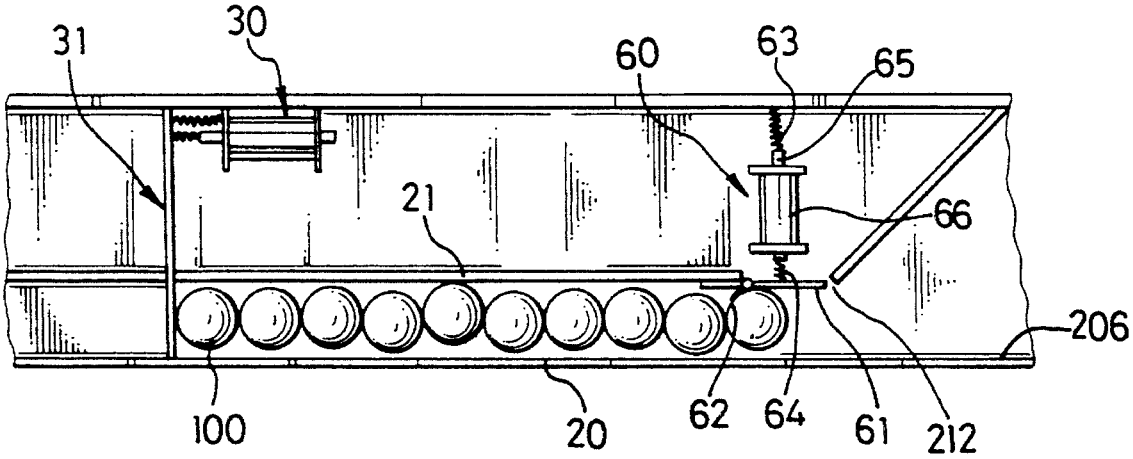
FIG. 5 is a top plan partially cutaway cross-sectional view of FIG. 1.
Figure 6:
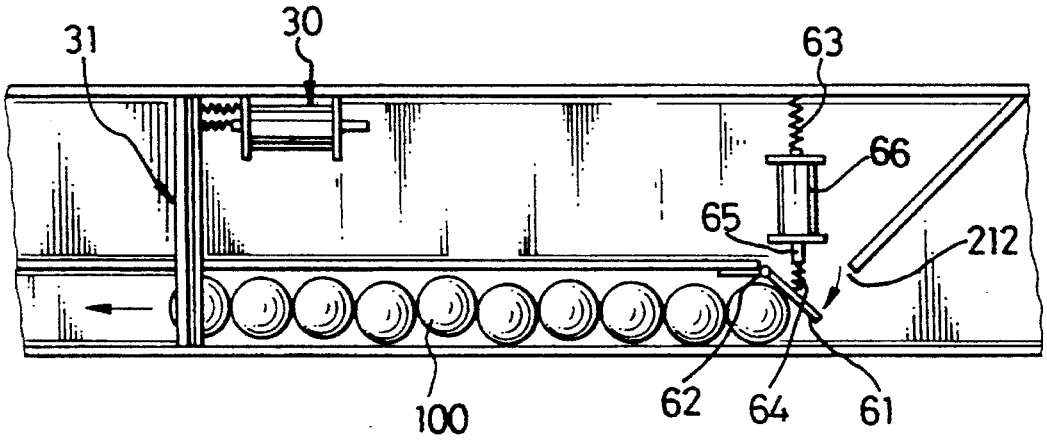
FIG. 6 is an operational view of FIG. 5.

Referring to FIGS. 5 and 6, the guiding plate 21 is cut at one distal end thereof, thereby defining an opening 212. An urging plate 61 is received in the opening 212 and is pivotally mounted on a pivot axle 62 which is fixedly mounted on the guiding plate 21. A third spring 64 has a first end attached to the urging plate 61 and a second end attached to a first end of a rod 65 which is slidably mounted in a control cylinder 66 fixedly mounted on the base 20 and has a second end connected with a first end of a fourth spring 63 whose second end is attached to one side of the base 20.

When the gate 31 is opened as shown in FIG. 6, the urging plate 61 is forced to pivot about the pivot axle 62 synchronously by means of the control panel 50 via the control cylinder 66 together with the rod 65 from a position as shown in FIG. 5 to a location as shown in FIG. 6, thereby urging the golf balls 100 to move forwardly.

Figure 7:
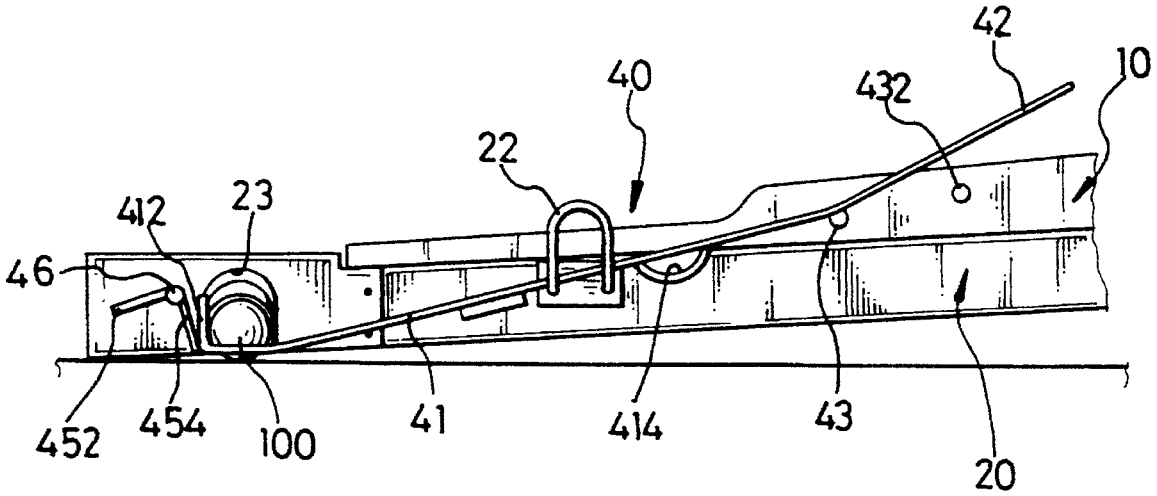
FIG. 7 is a front plan partially cutaway view of FIG. 1.
Figure 8:
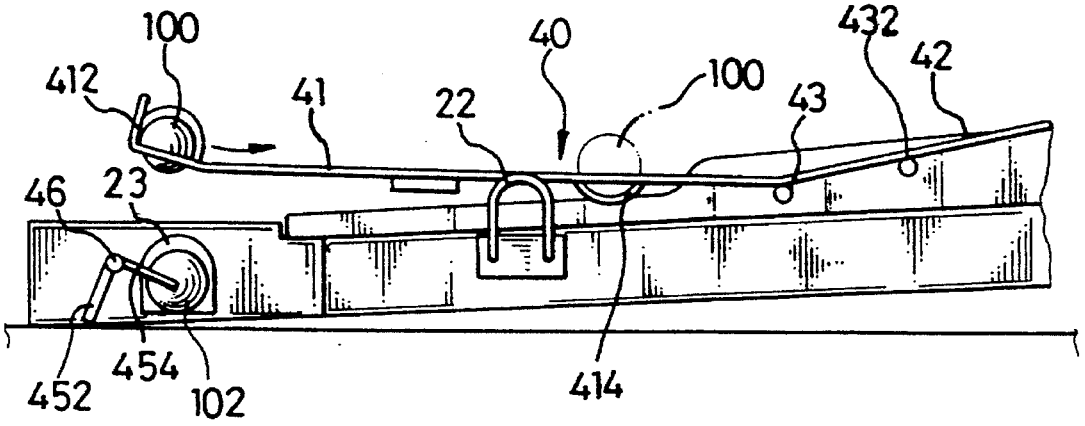
FIG. 8 is an operational view of FIG. 7.

Referring to FIGS. 7 and 8 with reference to FIG. 1 and 2, an elongated plate 10 is mounted on the base 20 and includes first and second end portions 102 and 104 each having a first side and a second side. The first end portion 102 is at a level lower than that of the second end portion 104. An artificial sod 15 smoothly covers the elongated plate 10.

A substantially V-shaped flange 11 is formed on the first end portion 102 of the elongated plate 10 and protrudes upwardly therefrom. A first socket 13 is defined through the artificial sod 15 and the second end portion 104 of the elongated plate 10 and communicates with the passage 206. Two second sockets 131 are defined through the artificial sod 15 and a mediate portion of the elongated plate 10 and communicate with the passage 206.

A pivot member 40 is pivotally mounted on the elongated plate 10 and includes a pivot axle 43 fixedly mounted on the first side of the first end portion 102 of the elongated plate 10. A first lever 41 has a first end which has a supporting bracket 412 fixedly mounted thereon and a second end which is pivotally mounted on the pivot axle 43 and has a recess 414 defined therein. A second lever 42 is fixedly attached to the second end of the first lever 41 to pivot therewith about the pivot axle 43.

The pivot member 40 is pivoted between a first position where the first end of the first lever 41 is at a lowermost level thereof such that one of the plurality of golf balls 100 is able to move through the inlet hole 23 to be retained on the supporting bracket 412 as shown in FIG. 7, and a second position where the first lever,41 is disposed at a substantially horizontal or slightly inclined state such that the golf ball 100 is able to move from the supporting bracket 412 towards the second end of the first lever 41 and is then transported into the artificial sod 15 of the elongated plate 10 via the recess 414 as shown in FIG. 8. Preferably, a guiding bar 416 is mounted on the second end of the first lever 41 and located beside the recess 414 for facilitating the golf ball 100 to be introduced thereinto.

The golf ball 100 is then delivered to a lowermost portion of the V-shaped flange 11 due to an inclination of the elongated plate 10.

Preferably, a pivot rod 46 is fixedly mounted on the first side of the first end portion 202 of the base 20 and is located beside the inlet hole 23. A substantially V-shaped counterweight 45 is pivotally mounted on the pivot rod 46 and includes a first weighted plate 452 and a second weighted plate 454 which has a weight smaller than that of the first weighted plate 452 and is detachably rested on the supporting bracket 412 when the pivot member 40 is at the first position thereof as shown in FIG. 7.

When the first lever 41 is elevated to a level as shown in FIG. 8, the second weighted plate 454 is forced to block the inlet hole 23 due to gravity action, thereby preventing a next golf ball 102 from being released from the inlet hole 23. Preferably, a supporting bracket 22 is fixedly mounted on the first side of the first end portion of the base 20 for supporting the first lever 41 as shown in FIG. 7. In addition, a projection 432 is formed on the first side of the first end portion 102 of the elongated plate 10 for stopping further movement of the second lever 42 as shown in FIG. 8.

Figure 9:
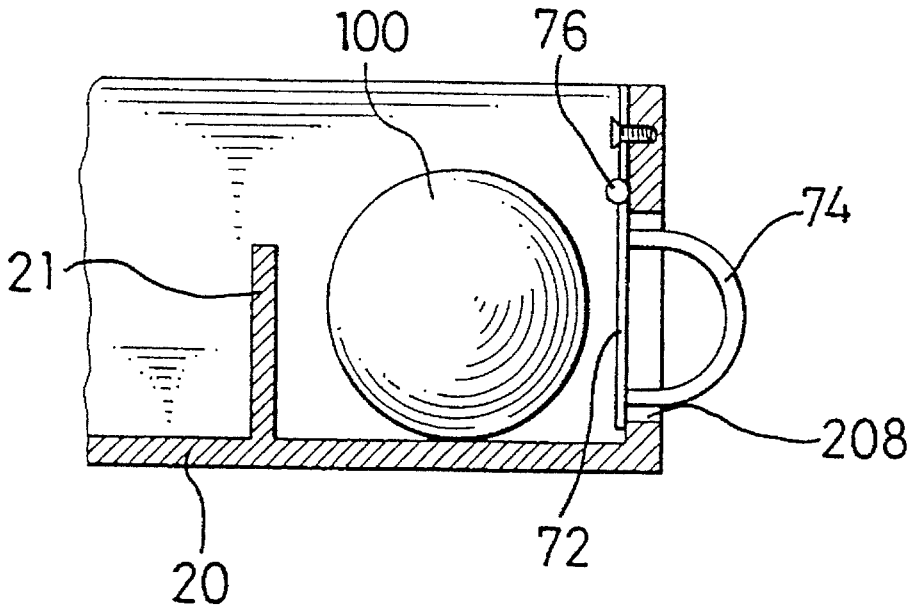
FIG. 9 is a left side partially cutaway cross-sectional view of FIG. 1.
Figure 10:
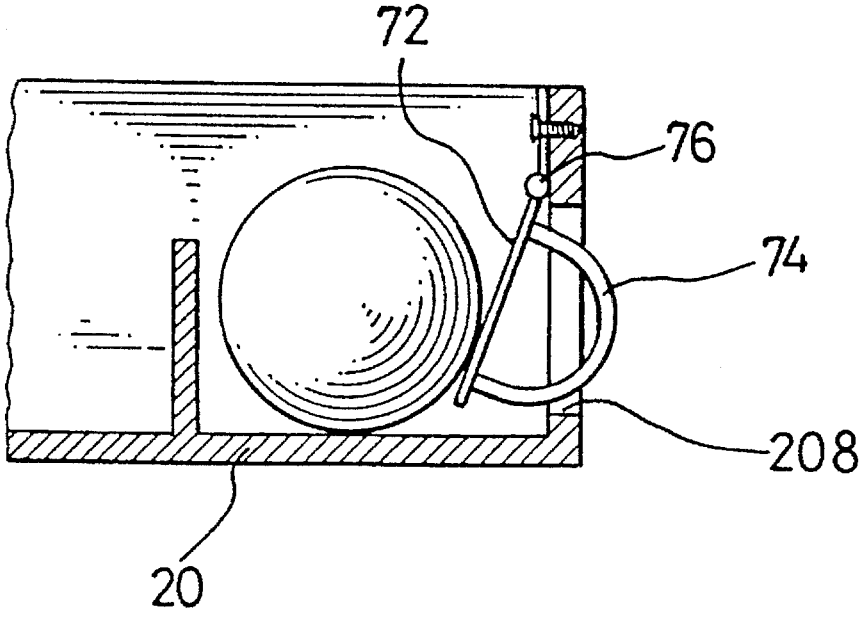
FIG. 10 is an operational view of FIG. 9.

Referring to FIGS. 9 and 10 with reference to FIGS. 1 and 2, a sheet plate 72 is pivotally mounted on a pivot axle 76 which is fixedly attached to an inner wall of the first side of the first end portion 202 of the base 20. An ear 74 is fixedly mounted on the sheet plate 72 and protrudes outwards of a slot 208 which is laterally defined in the first side of the first end portion 202 of the base 20. The sheet plate 72 is able to pivot from a position as shown in FIG. 9 to a location as shown in FIG. 10, thereby urging the golf balls 100 along a lateral direction thereof such that the golf balls 100 are not blocked together.

In operation, referring to FIGS. 1 and 2, the golf ball 100 is supplied from the inlet hole 23 of the base 20 into the artificial sod 15 through the recess 414 by means of operation of the pivot member 40 and is moved to be retained on the V-shaped flange such that a user can putt the golf ball 100 into the sockets 131 or 13 so as to practice a putt skill. Preferably, a bulge region 12 is mounted between the artificial sod 15 and the elongated plate 10 and is located in front of the socket 13 for increasing a difficulty in practicing the putt skill.

A motor 80 is fixedly mounted on an underside of the elongated plate 10 for rotating a motor shaft 82. Two rods 84 and 86 are each fixedly mounted on a corresponding one of two distal ends of the motor shaft 82 to rotate therewith and are each rotatably urged in a corresponding one of two cavities 122 and 124 which are respectively defined in the underside of the elongated plate 10.

Figure 11:
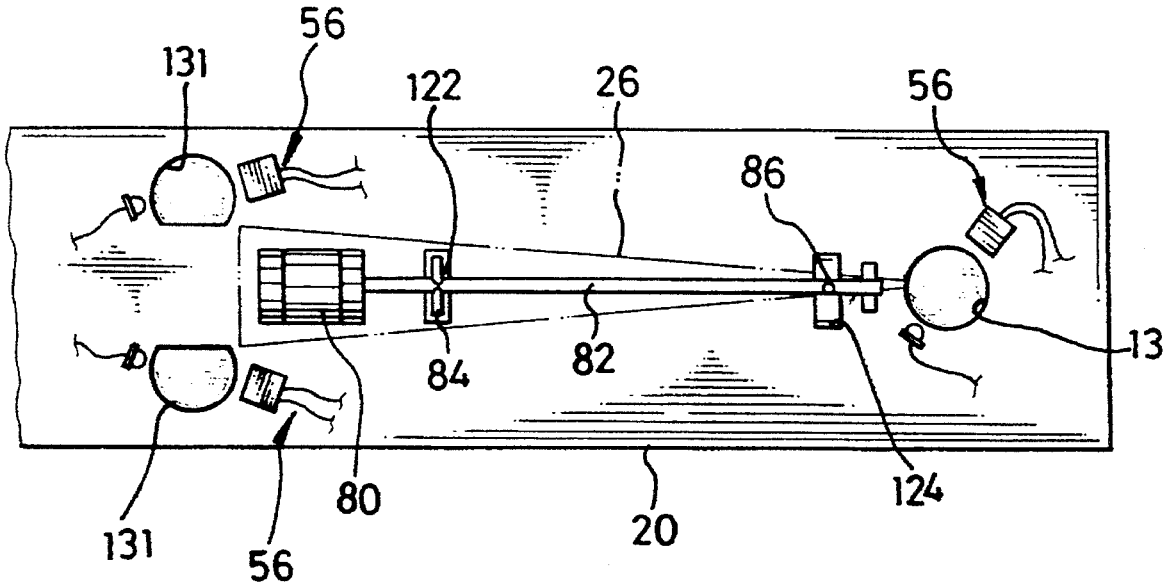
FIG. 11 is a bottom plan partially cutaway cross-sectional view of FIG. 1.

Referring to FIGS. 2 and 11, the two rods 84 and 86 are perpendicular to each other such that when the motor shaft 82 is rotated by the motor 80, the two rods 84 and 86 are able to urge the bulge region 12 upwardly at a different time such that the bulge region 12 is made to have a corrugated configuration. Preferably, a substantially triangular rib 26 is formed on the base 20 and is located below the motor 80 and the motor shaft 82. In addition, three sensors 56 are respectively mounted beside the sockets 131 and 13 so as to calculate the number of the golf balls 100 passing therethrough.

It should be clear to those skilled in the art that further embodiments of the present invention may be made without departing from the teachings of the present invention.

What is claimed is:

1. A golf practice device comprising:

an inclined elongated base (20) having a plurality of golf balls (100) contained therein and including first and second end portions (202) and (204) each having a first side and a second side, said first end portion (202) being at a level lower than that of said second end portion (204), a passage (206) defined in said base (20) for said plurality of golf balls (100) to pass therethrough, an inlet hole (23) laterally defined in the first side of said first end portion (202) of said base (20) and communicating with said passage (206), a guiding plate (21) mounted in said passage (206) for guiding said plurality of golf balls (100) into said inlet hole (23);

a gate operating mechanism (30) mounted in said passage (206) of said base (20) and operating between a first module in which said plurality of golf balls (100) are stopped by said gate operating mechanism (30) and a second module in which said plurality of golf balls (100) are able to pass therethrough;

a control panel (50) mounted on the second end portion (204) of said base (20) for operating said gate operating mechanism (30);

an elongated plate (10) mounted on said base (20) and including first and second end portions (102) and (104) each having a first side and a second side, said first end portion (102) being at a level lower than that of said second end portion (104), an artificial sod (15) covered on said elongated plate (10), a substantially V-shaped flange (11) formed on the first end portion (102) of said elongated plate (10) and protruding upwardly therefrom, a first socket (13) defined through said artificial sod (15) and the second end portion (104) of said elongated plate (10) and communicating with said passage (206), at least one second socket (131) defined through said artificial sod (15) and a mediate portion of said elongated plate (10) and communicating with said passage (206); and a pivot member (40) pivotally mounted on said elongated plate (10) and including a pivot axle (43) fixedly mounted on the first side of the first end portion (102) of said elongated plate (10), a first lever (41) having a first end which has a supporting bracket (412) fixedly mounted thereon and a second end which is pivotally mounted on said pivot axle (43) and has a recess (414) defined therein, and a second lever (42) fixedly attached to the second end of said first lever (41) to pivot therewith about said pivot axle (43), said pivot member (40) being pivoted between a first position where the first end of said first lever (41) is at a lowermost level thereof such that one of said plurality of golf balls (100) is able to move through said inlet hole (23) to be retained on said supporting bracket (412), and a second position where said first lever (41) is disposed at a substantially horizontal state such that said golf ball (100) is able to move from said supporting bracket (412) into said recess (414) and into said artificial sod (15).

2. The golf practice device in accordance with claim 1, wherein said gate operating mechanism (30) comprises a pivot shaft (32) transversely and fixedly mounted on a mediate portion of said base (20), a gate (31) pivotally mounted on said pivot shaft (32) and having first and second end portions (312) and (314) each pivoting about said pivot shaft (32), a first spring (33) having a first end attached to the first end portion (312) of said gate (31) and a second end, a control cylinder (36) fixedly mounted on said base (20), a rod (35) slidably mounted in said control cylinder (36) and having one distal end connected with the second end of said first spring (33), a second spring (34) having a first end attached to the second end portion (314) of said gate (31) and a second end attached to said base (20).

3. The golf practice device in accordance with claim 1, further comprising a pivot rod (46) fixedly mounted on the first side of said first end portion (202) of said base (20) and located beside said inlet hole (23), a substantially V-shaped counterweight (45) pivotally mounted on said pivot rod (46) and including a first weighted plate (452) and a second weighted plate (454) which has a weight smaller than that of said first weighted plate (452) and is detachably rested on said supporting bracket (412) when said pivot member (40) is at the first position thereof.

* * * * *